US005897116A

United States Patent [19]

Yiu

[11] Patent Number: 5,897,116

[45] Date of Patent: Apr. 27, 1999

[54] DARTBOARD HAVING IMPROVED SLIDING SEGMENTS

[76] Inventor: Chih-Hao Yiu, 6F-2, No. 160, Chung-Kang Road Sec. 1, Taichung, Taiwan

[21] Appl. No.: 09/013,160

[22] Filed: Jan. 26, 1998

[51] Int. Cl.[6] ..... F41J 3/00

[52] U.S. Cl. ..... 273/408; 273/376

[58] Field of Search ..... 273/374, 376, 273/378, 403, 404, 408

[56] References Cited

U.S. PATENT DOCUMENTS

| | | | |
|---|---|---|---|
| 4,836,556 | 6/1989 | De Vale et al. | 273/376 |
| 5,417,437 | 5/1995 | Coppard et al. | 273/403 |
| 5,482,291 | 1/1996 | Houriet, Jr. et al. | 273/376 |
| 5,601,290 | 2/1997 | Yiu | 273/376 |
| 5,626,344 | 5/1997 | Huang | 273/376 |

*Primary Examiner*—William H. Grieb
*Attorney, Agent, or Firm*—Charles E. Baxley, Esq.

[57] ABSTRACT

A dartboard includes a circular spider disposed on an upper portion. The circular spider includes a series of circumferentially and radially extending ribs for forming a number of dart areas and for slidably receiving and engaging with a number of dart segments. The dart segments each includes a lower peripheral portion having one or more stops extended laterally outward of the dart segment for engaging with the lower portion of the ribs of the spider and for preventing the dart segments from being disengaged from the dartboard. The stops of the dart segments are staggered relative to each other for preventing the stops from being engaged with each other.

1 Claim, 3 Drawing Sheets

DARTBOARD HAVING IMPROVED SLIDING SEGMENTS

BACKGROUND OF THE INVENTION

1. Field of the Invention

The present invention relates to a dartboard, and more particularly to a dartboard having a target frame that has a compact configuration for preventing the segments from being disengaged from the dartboard.

2. Description of the Prior Art

As shown in FIG. 1, a typical dartboard comprises a dartboard body 11 having a spider 12 provided in the upper portion. The spider 12 is generally circular in shape including a series of circumferentially and radially extending ribs for defining a number of dart areas and for slidably receiving a number of dart segments 13 which are slidably engaged in the dart areas. The spider is normally made by plastic material and includes a number of cusps 14 formed on the top of the series of circumferentially and radially extending ribs for engaging with the segments 13 and for preventing the segments 13 from being disengaged from the dartboard body 11. However, the cusps 14 should include a certain width for engaging with the segments 13 such that the cusps 14 includes a large size that may seriously affect the shooting of the darts against the dartboard areas.

The present invention has arisen to mitigate and/or obviate the afore-described disadvantages of the conventional dartboards.

SUMMARY OF THE INVENTION

The primary objective of the present invention is to provide a dartboard including a spider having no wide cusps for engaging with the segments and including the segments having an improved structure for allowing the segments to be engaged with the spider and to be prevneted from being disengaged from the dartboard body.

In accordance with one aspect of the invention, there is provided a dartboard comprising a dartboard body including a upper portion, a spider provided on the upper portion of the dartboard body and including a series of circumferentially and radially extending ribs for defining a plurality of dart areas, the ribs of the spider including a upper portion and a lower portion, and a plurality of dart segments slidably engaged in the dart areas of the dartboard. The dart segments each includes a lower peripheral portion having a stop extended laterally outward of the lower peripheral portion of the dart segment for engaging with the lower portion of the ribs of the spider and for preventing the dart segments from being disengaged from the dartboard body, the stops of the dart segments are staggered relative to each other for preventing the stops from being engaged with each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
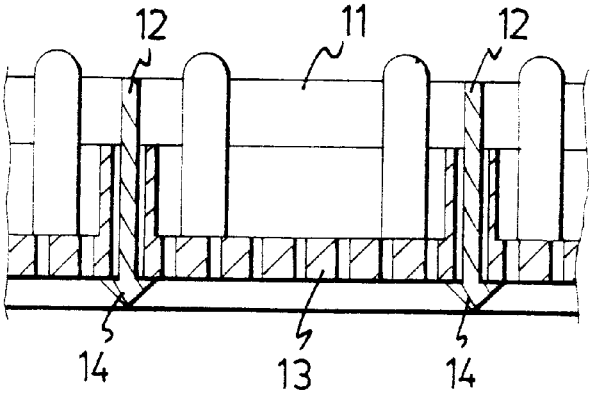
FIG. 1 PRIOR ART
FIG. 1 is a partial cross sectional view of a typical dartboard.
Figure 4:
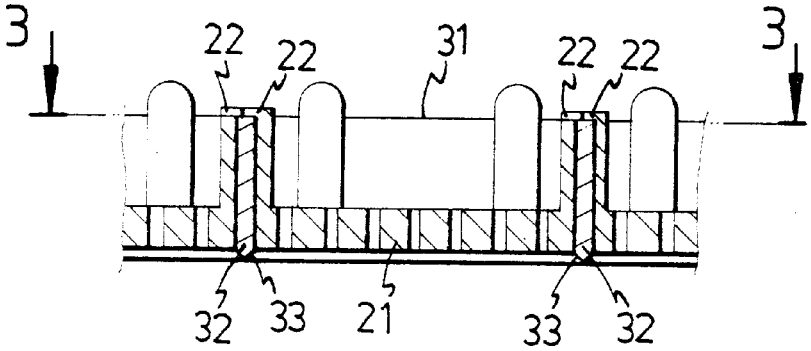
FIG. 4 is a partial cross sectional view taken along lines 4—4 of FIG. 3.
Figure 2:
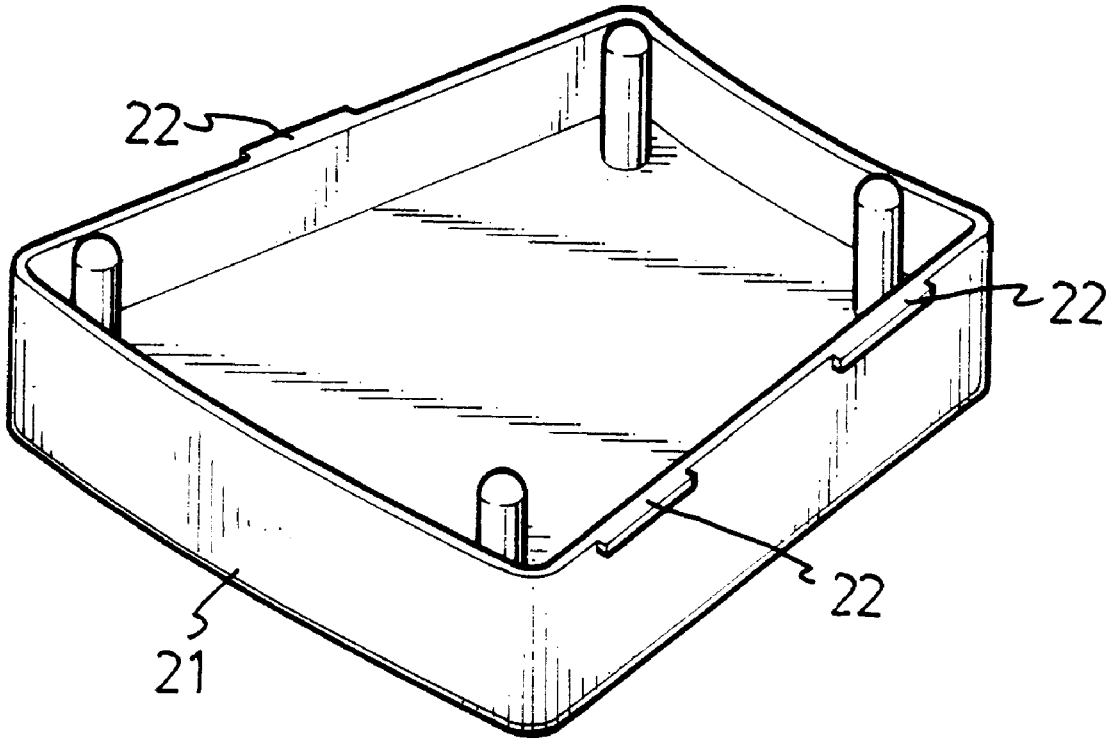
FIG. 2 is a bottom perspective view of a segment of a dartboard in accordance with the present invention.
Figure 3:
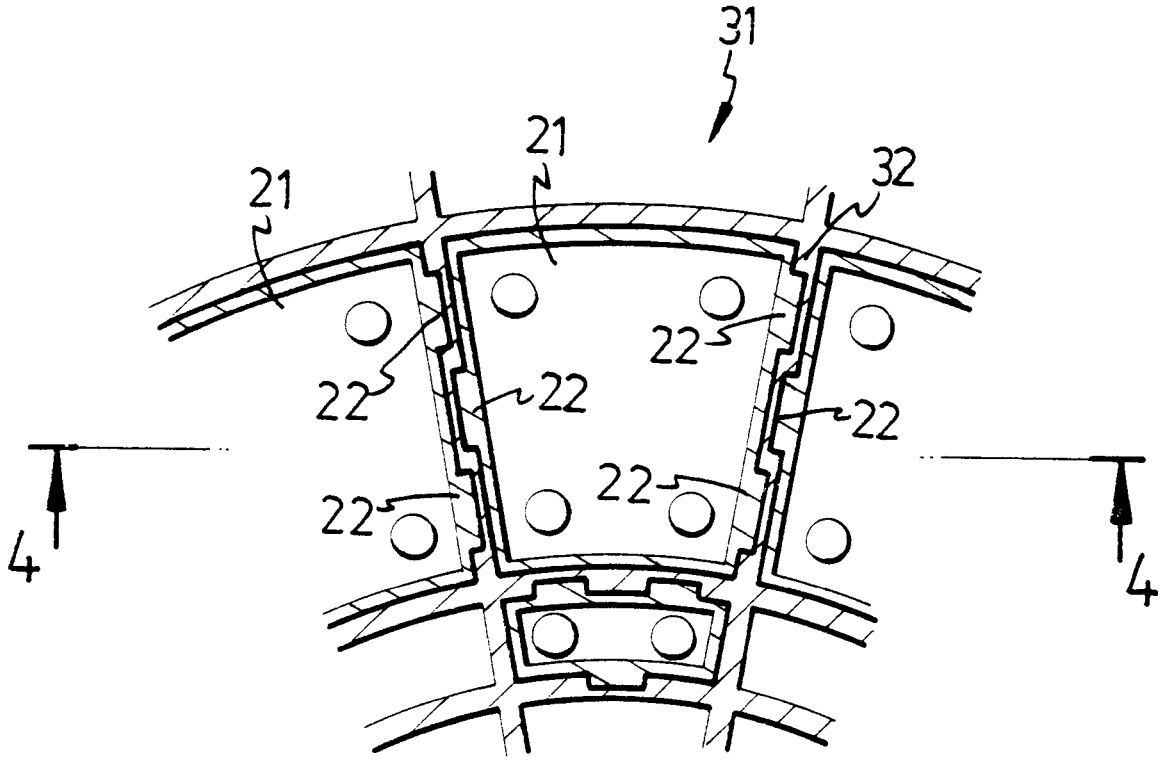
FIG. 3 is a partial cross sectional view taken along lines 3—3 of FIG. 4, in which the dartboard is disposed up-side-down.

Referring to FIGS. 2–4, a dartboard in accordance with the present invention comprises a dartboard body 31 including a spider 32 provided in the upper portion. The spider 32 is generally circular in shape including a series of circumferentially and radially extending ribs for deining a number of dart areas and for slidably receiving a number of dart segments 21 which are slidably engaged in the dart areas. It is to be noted that the dartboard and the dart segments are disposed up-side down in the drawings. The circumferentially and radially extending ribs of the spider 32 each includes a cusp 33 formed in the upper portion and having two tapered surfaces for guiding the darts toward the dart segments 21.

The dart segments 21 each includes a bottom portion having one or more stops 22 extended laterally outward from the peripheral portion for engaging with the ribs of the spider 32 and for preventing the dart segments 21 from being disengaged from the spider 32. As best shown in FIG. 3, the stops 22 of the adjacent dart segments 21 are staggered relative to each other for preventing the stops 22 from being engaged with each other and for prevneting the movement of one dart segment 21 to be interferred by the other dart segments 21.

It is to be noted that the ribs of the spider 32 may thus be made to a greatly decreased thickness, such that the influence of the cusps 33 of the spider 32 to the darts may be greatly decreased.

Accordingly, the dartboard includes a spider having no wide cusps for engaging with the dart segments and includes the dart segments having an improved structure for allowing the segments to be engaged with the spider and to be prevneted from being disengaged from the dartboard body and for allowing the spider ribs to have a greatly decreased thickness.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dartboard comprising:

a dartboard body including a upper portion, a spider provided on said upper portion of said dartboard body and including a series of circumferentially and radially extending ribs for defining a plurality of dart areas, said ribs of said spider including a upper portion and a lower portion, and a plurality of dart segments slidably engaged in said dart areas of said dartboard, said dart segments each including a lower peripheral portion having a stop extended laterally outward of said lower peripheral portion of said dart segment for engaging with said lower portion of said ribs of said spider and for preventing said dart segments from being disengaged from said dartboard body, said stops of said dart segments being staggered relative to each other for preventing said stops from being engaged with each other.

* * * * *